United States Patent [19]

Stefansson

[11] Patent Number: 4,522,385

[45] Date of Patent: Jun. 11, 1985

[54] SHEET FEEDER SYSTEMS

[75] Inventor: Rafn Stefansson, San Marino, Calif.

[73] Assignee: Bell & Howell Company, Chicago, Ill.

[21] Appl. No.: 421,655

[22] Filed: Sep. 22, 1982

[51] Int. Cl.[3] ..... B65H 3/52

[52] U.S. Cl. ..... 271/10; 271/116; 271/122; 271/270

[58] Field of Search ..... 271/10, 116, 122, 270

[56] References Cited

U.S. PATENT DOCUMENTS

| | | | |
|---|---|---|---|
| 3,108,801 | 10/1963 | Van Dalen | 271/122 |
| 3,761,079 | 9/1973 | Azure | 271/116 |
| 4,030,723 | 6/1977 | Irvine | 271/116 X |
| 4,032,135 | 6/1977 | Rüenzi | 271/116 |
| 4,303,234 | 12/1981 | Plum | 271/109 |

*Primary Examiner*—Richard A. Schacher

*Attorney, Agent, or Firm*—Benoit Law Corporation

[57] ABSTRACT

Methods and apparatus for transporting sheets from a stack advance each top sheet from the stack in turn to a first location and reject any adjacent sheet moving along with such top sheet from the stack. The advancing top sheet is driven at the first location away from the stack at a predetermined speed, which is preferably higher than the speed at which each sheet is advanced to the first location, whereby a delay may be realized between the time a given sheet leaves the first location and the time at which the next succeeding sheet is advanced at the first location. Each advanced top sheet is also engaged at a second location while such top sheet is still being driven at the first location until such top sheet has been driven past the first location. At that time, such engaged top sheet at the second location is accelerated away from the first location at a speed higher than the mentioned predetermined speed, so that successive sheets are positively separated from each other, preferably by intervening gaps, in the disclosed transporting systems.

20 Claims, 3 Drawing Figures

SHEET FEEDER SYSTEMS

BACKGROUND OF THE INVENTION

The subject invention relates to sheet transporting methods and apparatus, sheet feeder systems, and methods and apparatus for transporting documents, papers, sheet-like material and sheets from a stack.

There has been an increasing demand for sheet transporting methods and apparatus, sheet feeder systems, and methods and apparatus for transporting documents, papers, sheet-like material and other sheets from a stack, rapidly and reliably without paper jams and other disturbances.

To a large extent, this demand has been sparked by the desire of public utilities, banks and other institutions to economize, automate and speed up the processing of payments by customers. In practice, the resulting advanced remittance processing systems require high-speed stackers and unstackers or sheet feeders capable of handling such items as bank checks and remittance stubs of various intermixed lengths, thicknesses, formats, textures and surface finishes. Such sheet feeding systems are to be capable of feeding or unstacking received documents or sheets in their original sequential order in which they were fed into the stacking apparatus or stack from which the documents or sheets are to be fed.

To avoid jams, document or account mixup and other disagreeable disturbances, it is most important that the documents or sheets be clearly, reliably and rapidly separated from each other during any unstacking process.

In this respect, the utility of the subject invention is not limited to remittance processing, or to any other field herein particularly emphasized, but may extend to microfilm or microfiche systems or to a great variety of other sheet stacking and unstacking processes and equipment.

By way of example, reference may be had to U.S. Pat. No. 4,303,234, by Dale Plum, issued Dec. 1, 1981 for Deskewing Document Feed Tray, to the common assignee hereof.

The system disclosed in that patent feeds a plurality of documents in a document transport system under the force of gravity toward a document pickup and curls each document slightly as it approaches the pickup, so as to give the document a force element pushing a portion thereof against the pickup. The lowermost corner of a skewed curled document is pressed against a stationary surface to square it against such surface, thereby reducing any skewing relative thereto. The squared document is delivered into the nip of a pair of pickup rollers.

In practice, one of the pickup rollers, such as the lower roller, may be spring-loaded into direct contact with the other or upper roller, when no documents are being fed into the unit. The lower roller is then driven at a reverse torque to the upper roller, but the upper roller overcomes such reverse torque, causing the lower roller to turn in the forward direction as long as it is in direct or indirect driving engagement with the top roller.

When multiple documents are fed to the nip between the rollers, the upper roller pulls only the top document into the transport, while the lower roller enganges the next lower document, rejecting it by action of the reverse torque at which the lower roller is driven through a slip clutch.

The objective thus is to drive only one document at the time into or through the transport.

SUMMARY OF THE INVENTION

It is a general object of this invention to meet the above mentioned and similar needs.

It is a germane object of this invention to provide improved sheet transporting methods and apparatus, improved sheet feeding systems, and improved methods and apparatus for transporting sheets from a stack rapidly, reliably and without jamming or other disturbances.

It is a related object of this invention to increase the versatility of sheet feeding or unstacking systems.

Other objects will become apparent in the further course of this disclosure.

From a first aspect thereof, the subject invention resides in methods and apparatus for transporting sheets from a stack and, more specifically, resides in the improvement comprising, in combination, the steps of, or means for, advancing from the stack each top sheet in turn to a first location, rejecting at such first location any adjacent sheet moving along with the top sheet from the stack, providing driving means for driving the advancing top sheet at the first location away from the stack, engaging the top sheet at a second location while such top sheet is being driven at the first location, continuing to drive the top sheet at the first location with the driving means until such top sheet has been driven past the first location, and accelerating the engaged top sheet at the second location only after the top sheet has been driven past the first location away from the first location.

Other aspects of the invention will become apparent in the further course of this disclosure, and no limitation to any aspect, combination, feature or element is intended by any part of the subject summary of the invention.

BRIEF DESCRIPTION OF THE DRAWINGS

The subject invention and its various aspects and objects will become more readily apparent from the following description thereof, illustrated by way of example in the accompanying drawings, in which like reference numerals designate like or functionally equivalent parts, and in which.

DESCRIPTION OF PREFERRED EMBODIMENTS

Figure 1:
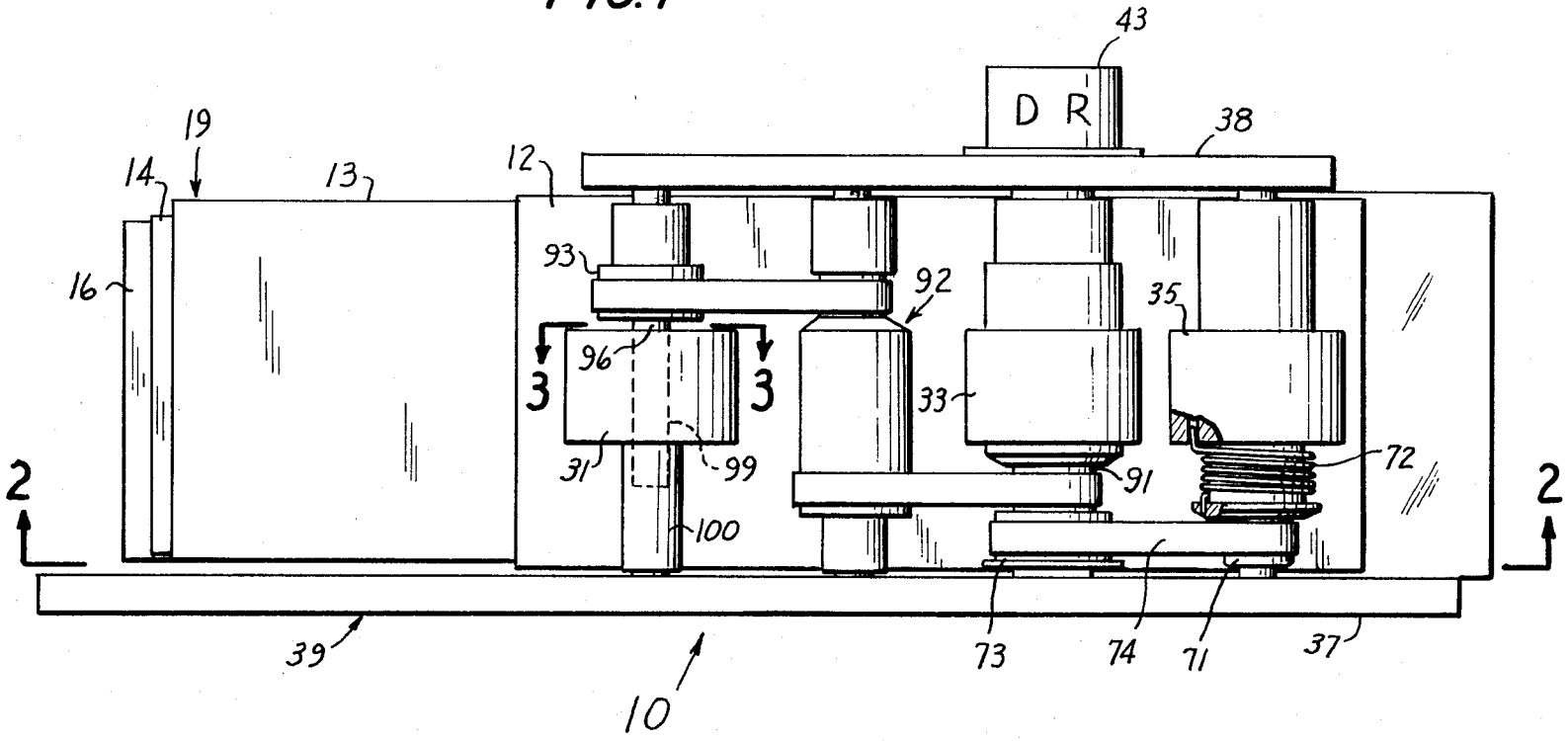
FIG. 1 is a top view of a sheet feeding apparatus according to a preferred embodiment of the subject invention.
Figure 2:
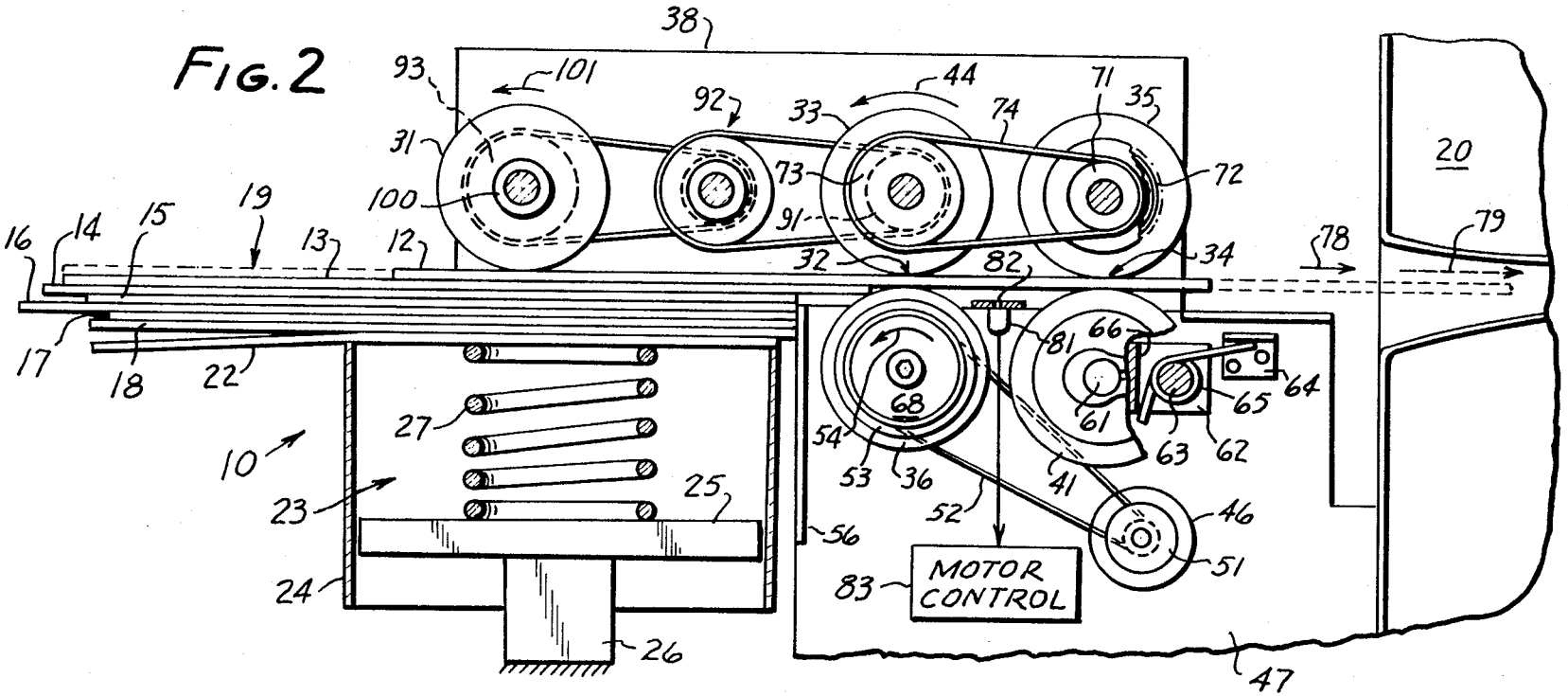
FIG. 2 is a section taken on the line 2—2 in FIG. 1.
Figure 3:
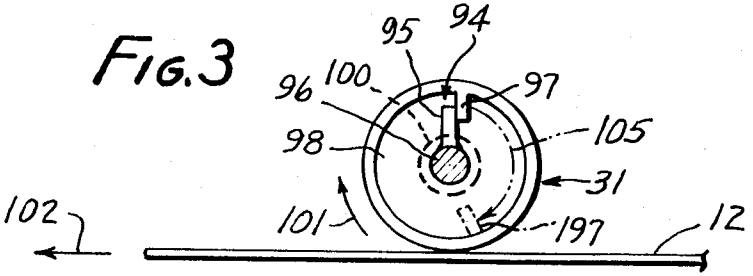
FIG. 3 is a detail view section taken along the line 3—3 in FIG. 1.

The sheet feeding apparatus 10 shown in FIGS. 1 to 3 may be employed for feeding sheets 12, 13, 14, 15, 16, 17, and 18 from a stack 19 to a processing station diagrammatically shown in FIG. 2 at 20. In this respect, while FIG. 1 may be taken as a top view and FIG. 2 as a side view, the apparatus 10 may be oriented such that FIG. 2 represents the top view, while FIG. 1 then may be taken as a side view section seen from the sheet advancement path. Indeed, it is a feature of versatility of a preferred embodiment of the subject invention that its apparatus does not depend on gravity effects for its proper operation, and may thus be employed in any positional orientation.

The documents 12 to 18 in the stack 19 are first positioned onto or against the top plate 22 of a sheet stacker 23. For instance, the stack 19 may be inserted onto or against the stacker plate 22 by hand, or the sheets 12 to 18 may be fed successively or collectively to the stacker 23 by any of several stacking methods or systems.

The stacker plate 22 has a skirt 24 riding along a baseplate 25. This stacker baseplate may be rigidly supported at 26. A spring 27 acts between the stacker baseplate 25 and the stack supporting plate 22 in order to urge the stack 19 toward a first roller 31 of the sheet transport or unstacker 10. The first roller thus contacts each of the top sheets 12, 13, 14, etc., in turn, and is driven to advance from the stack 19 each of these top sheets in turn to a first location 32 where a second roller 33 is located. The second roller 33 serves to drive an advancing top sheet, such as the sheet 12, away from the stack 19 at a predetermined speed to a second location 34 where a third roller 35 is located.

A fourth roller 36 is situated at the first location 32 in order to reject any adjacent sheet, such as the sheet 13, moving along with a top sheet, such as the sheet 12, from the stack when such top sheet is advanced from the stack 19 by roller 31.

The rollers 33 and 36 may thus constitute the above mentioned pair of rollers for selectively advancing and at the same time rejecting sheets from the stack 19, so that only one sheet at a time is delivered to the transport or processor 20, as more fully described below.

The rollers 31, 33 and 35 are rotatably mounted or journaled by and between mounting plates 37 and 38 forming part of an apparatus frame 39. The rollers 31, 33, 35 and 36, as well as a fifth roller 41, may be provided with a rubber tire or elastomeric sleeve contacting each sheet advanced from the stack 19.

An electric motor 43 attached to the frame plate 38 as shown in FIG. 1, or another suitable drive, is coupled to the roller 33 and rotates such second roller in the direction of an arrow 44 shown in FIG. 2 for advancement of each top sheet 12, 13, 14, etc., delivered by the roller 31 to the second location 32 into driving engagement with the roller 33.

The fourth roller 36 is driven by an electric motor 46 attached to a frame plate 47, or by another drive via a first pulley 51, transmission belt 52 and second pulley 53 in a direction indicated by an arrow 54 in FIG. 2 and being opposed to the sense of rotation 44 of the second roller 33. An optional sheet entry gate 56 is supported by the frame plate 47 at the stacker 23.

The fourth and fifth rollers 36 and 41 are rotatably mounted or journaled on the frame plate 47 and project into engagement with the second and third rollers 33 and 35, respectively, or into contact with any top sheet 12, etc., advanced therebetween. To this end, rollers 36 and 41 are resiliently biased toward rollers 33 and 35, respectively. For instance, roller 41 may have an axis 61 mounted on a bracket 62 pivoted on a pin 63 attached to the frame plate 47. The wheel 41 is thus swiveled about the pin 63 for angular movement relative to the frame plate 47 toward and away from the third roller 35. A further bracket 64 is attached to the frame plate 47, and a spring 65 coiled about the stationary pin 63 has a first end in engagement with the stationary bracket 64 and a second end in engagement with a lug 66 of the angularly movable bracket 62. In this manner, the coiled spring 65 biases the fifth roller 41 toward the third roller 35, so that these two rollers contact each other, forming a nip for receiving any sheet 12, 13, 14, etc., advancing into the second location 34.

The fourth roller 36 may be pivotally mounted in the same manner as the fifth roller 41, even though such mount is not shown in the drawing so as to avoid crowding thereof. Of course, any known method may be employed for biasing the fourth roller 36 against the second roller 33.

Moreover, the fourth roller 36 is coupled to its drive pulley 53 by a slip clutch 68. As long as the fourth roller 36 is in contact with the second roller 33, the motor 43 or similar drive of the roller 33 is able to overcome the friction of the slip clutch 68, thereby overcoming the drive of the motor 46 so that the fourth roller 36 is rotated by the second roller 33 in a direction opposed to the sense of rotation indicated by the arrow 54 in FIG. 2.

The rollers 33 and 36 thus form a nip for receiving and driving any top sheet 12, 13, 14, etc. successively advanced from the stack 19 by action of the first roller 31.

On the other hand, if any top sheet, such as the advancing top sheet 12, should drag along an adjacent sheet, such as the next lower sheet 13, from the stack 19, then such advancing sheet 13 would enter the nip between the rollers 33 and 36 in addition to the top sheet 12. Of course, the top sheet 12 would then still remain in engagement with the second roller 33 and would continue to be advanced thereby to the second location 34 into engagement with the third roller 35. However, the intervening adjacent sheet 13 would in effect separate the fourth roller 36 from the advancing top sheet 12, whereby the friction of the clutch 68 becomes sufficient to break any frictional adhesion between the sheets 12 and 13. Accordingly, the second motor 46 now drives the roller 36 via slip clutch 68 in the direction of the arrow 54, whereby the sheet 13 is effectively rejected at the second location 32. In that manner, only the topmost sheet, such as the illustrated sheet 12 can advance at the time until it has been driven past the first location 32.

However, without the features according to the subject invention presently to be described, the illustrated apparatus would not operate satisfactorily. For instance, if it were not for the special features of the rollers 31 and 35 more fully described below, the roller 33 would simply contact and advance the next lower sheet 33, as soon as the top sheet 12 has left the nip between rollers 33 and 36. This, in many situations, would not provide for a truly adequate separation between successive sheets, meeting the demand of modern document processing and other advanced systems.

Briefly, and as more fully described below, a preferred embodiment of the subject inventions equips the third roller 35 with such means as will assure rapid acceleration of any top sheet advanced past the first location 32 away from such first location, so that there always is a clear separation between any departing sheet, such as the sheet 12, and any succeeding sheet, such as the adjacent sheet 13.

Alternatively or additionally, an embodiment of the subject invention equips the first roller 31 with means assuring a delay between the time at which a top sheet 12 is driven past the first roller 31 and the time at which the first roller 31 is capable of driving the next adjacent sheet 13 into the nip between the rollers 33 and 36.

Reverting now first to the roller 35, it may be noted from FIG. 1 that such third roller is coupled to a drive pulley 71 via a torsion spring 72. The first motor 43 which drives the second roller 33 also drives the pulley 71 via a pulley 73 and transmission belt 74.

The pulley 71 has a smaller diameter than the pulley 73, whereby the pulley 71 is rotated at a higher rate than the pulley 73. On the other hand, the third roller 35 rotates at the same speed as the second roller 33 as long as both of these rollers engage the same sheet, such as the top sheet 12 as shown in FIG. 2. Accordingly, the transmission belt 74 acts on the torsion spring 72 via pulley 71 so as to tension such torsion spring.

The transmission belt 74 rotates the third roller 35 via pulley 71 and torsion spring 72 prior to advancement of a top sheet 12 into the nip between jointly rotating rollers 35 and 41. Because of the difference in diameters between the pulleys 71 and 73, the rate of rotation of the roller 35 is higher at that point than the rate of rotation of the roller 33. However, when an advancing top sheet 12 is driven into the nip between the rollers 35 and 31, the roller 35 cannot rotate faster than the roller 33 until such time as the particular top sheet has left the roller 33. In the meantime, the transmission belt 74 tensions the torsion spring 72 with the excess energy provided by the difference in diameters of the pulleys 71 and 73.

The driven transmission belt 74 and pulley 71 thus act as a charging means for tensioning the spring 72 and for thereby charging the energy storage means represented, by way of example, by the spring 72, while the top sheet 12 is being driven at the first location 32 by the second roller 33.

As soon as the particular top sheet, such as the sheet 12, has left the nip between the rollers 33 and 36 at the first location, the charged energy storage means or tensioned torsion spring 72 acts via third roller 35 in accelerating the top sheet engaged at the second location 34 away from the first location 32 at a higher speed than the predetermined speed at which the top sheet 12 was driven by the second roller 33.

By way of recapitulation, the second roller 33 continues to drive the top sheet 12 at the first location 32 until such top sheet has been driven past the first location 32, and the third roller 35 and charged energy storage at 72 accelerate the engaged top sheet at the second location 34 away from the first location 32 at the mentioned higher speed. Accordingly, the advanced top sheet 32 is rapidly separated from a subsequent adjacent sheet 13, whereby a clear gap is provided between such succeeding sheets 12 and 13.

Accordingly, the top sheet 12, after having been advanced by the second roller 33 at a predetermined speed indicated in FIG. 2 by an arrow 78, is subsequently accelerated and injected into the apparatus 20 by action of the third roller 35 and charged energy storage means 72 at a higher velocity indicated by a dotted arrow 79. In this respect, the so-called "predetermined speed" at which any top sheet is advanced by the roller 33 needs not necessarily be a constant speed. However, the speed to which a departing top sheet is accelerated via the third roller 35 is according to the currently disclosed embodiment of the subject invention higher than any sheet advancement speed imparted via roller 33.

The above mentioned resulting gap between a top sheet 12 and a succeeding adjacent sheet 13 is easily sensed by a photoelectric device 81 acting through an aperture 82 in the internal apparatus wall 56. If desired, the drive motor 43 may thus be stopped by action of the photocell 81 on a motor control 83 shown in FIG. 2, so as to assure that succeeding cards cannot accidentally be paired in the transport apparatus.

Alternatively, the photocell 81 and motor control 83 may be employed to shut down the unstacking operation if a succeeding sheet is backing into a departing top sheet, so that no gap occurs and is sensed by the photocell 81 between succeeding sheets.

An embodiment of the subject invention concerned with the first roller 31 provides a similar safeguard which may be employed alternatively to either or both of the safeguards disclosed above with the third roller 35 and/or photocell 81, in order to prevent a backing of any succeeding sheet into or too close to a departing top sheet. According to the illustrated preferred embodiment of the subject invention, the safety feature presently to be described concerning the first roller 31 is, however, employed in combination with at least the above mentioned safety feature concerning the third roller 35 and sheet accelerating spring or equivalent energy storage and release system 72.

In particular, the first roller 31 is driven by the motor 43 through a pulley 91 on the shaft of the second roller 33, a transmission 92 between the first and second rollers 31 and 33 and a pulley 93 coaxial with the first roller 31.

The pulley 93 is coupled to the first roller 31 by a rotary or angular lost-motion connection or dog-drive permitting a free-wheeling action between the first roller 31 and its drive or drive pulley 93.

Within the spirit and scope of the subject invention, the lost-motion connection, dog-drive or other free-wheeling facility just mentioned may take various forms. By way of example, FIG. 3 shows a dog-drive 94 operating with an arm 95 projecting radially from a shaft 96 of the pulley 93 and a dog or tooth 97 projecting inwardly into a hollow space 98 inside the first roller 31. The pulley shaft 96 is integral or otherwise rotates with the drive pulley 93 and interfits as indicated at 99 in FIG. 1 with the shaft 100 of the roller 31, with the pulley shaft 99 and the roller shaft 100 being rotatable relative to each other.

The motor 43 and transmission 92 drive the first roller 31 in a first sense of rotation indicated by the arrow 101 in FIGS. 2 and 3. In this respect, it should be noted that FIG. 3 is in effect a reversal or mirror image as far as the roller and sheet advancing action illustrated therein are concerned, since section 3—3 on which FIG. 3 is taken in FIG. 1 looks in a direction opposite the view of FIG. 2. Accordingly, the top sheet 12 appears to move in the view of FIG. 3 from right to left, as indicated by an arrow 102, while it is moving from left to right in the view of FIG. 2.

As long as any top sheet 12, 13, 14, etc., is driven only by the first roller 31, the tooth 97 remains in engagement with the radial arm 95, whereby the transmission 92 drives the pulley 93 and thereby the first roller 31 in the sense of rotation 101 for advancement, from the stack 19, of each top sheet in turn at a first speed to the first location 32.

The transmission 92 along with the dog-drive 94 constitutes a means for allowing between the first roller driving means or pulley 93 and the first roller 31 a free-wheeling action exceeding in speed the driving of the first roller via transmission 92 and pulley 93. To this end, the motor 43 acting via transmission 92 drives the first roller 31 at a rotational speed or velocity 101 which is lower than the rotational speed or velocity 44 at which the second roller 33 is driven. Accordingly, each top sheet 12, 13, 14, etc., is initially advanced from the stack 19 to the first location 32 at a speed lower than the mentioned predetermined speed at which each top sheet is driven by the second roller 33 in turn away from the stack 19 or first roller 31.

In this respect, the second roller 33 at the first location 32 engages the advancing top sheet 12 during its engagement, or while it is still being engaged, by the first roller 31 and drives such advancing top sheet away from the first roller 31 at a predetermined speed higher than the first speed at which the roller 31 advanced the top sheet to the first location 32. In this manner, the second roller 33, driven by the motor 43 somewhat faster than the first roller 31, provides the mentioned free-wheeling action between the first roller driving pulley 93 and the first roller 31. In terms of FIG. 3, the mentioned free-wheeling action causes the first roller 31 to rotate faster than the drive pulley 93 and pulley shaft 96, as the top sheet 12, being still in engagement with the first roller 31, is being pulled by the second roller 33 in the direction of the arrow 102 at a rate higher than the rate at which the driven roller 31 could advance such top sheet 12.

In other words, the top sheet 12, being now pulled away from the stack away by the roller 33 at the mentioned higher speed, rotates the roller 31 somewhat faster than the rate of rotation of the drive pulley 93, whereby an angular phase shift occurs between the tooth 97 of the first roller 31 and the arm 95 of the drive pulley shaft 96. In FIG. 3, such phase shift is indicated by a dotted arrow 105 between the solidly illustrated arm-engaging position of the tooth 97 and the free-wheeling position for such tooth shown, by way of example, in dotted outline at 197. In practice, the phase shift between arm 95 and tooth 97 and thereby the mentioned free-wheeling action may, of course, be larger than as indicated by the arrow 105. Two or more dog-drives similar to the illustrated drive 94 may, of course, be employed in cascade, if the free-wheeling action is desired to exceed a full circle.

Because of the mentioned free-wheeling action, the first roller 31 cannot act immediately on any subsequent top sheet, such as the next sheet 13, after departure therefrom of the preceding top sheet, such as the sheet 12. In this respect, after the second roller 33 has pulled the top sheet 12 out of its engagement with the roller 31, the spring 27, acting on the stack plate 22 and thereby on the stack 19, causes the next adjacent sheet 13 to engage the roller 31. However, due to the free-wheeling action 105, such first roller 31 cannot act immediately on the new top sheet 13 by way of advancement thereof. Rather, the fourth roller 36, driven via clutch 68 in the direction of arrow 54, continues to reject the adjacent sheet 13 at least until such time as the top sheet 12 has been advanced past the first location 32 at the second roller 33.

The second roller 33 thus takes up the adjacent sheet 13 at the first location 32 for advancement at the predetermined speed only after a delay from the departure of the top sheet 12 from the roller 31 or, in general terms, from a departure of the top sheet 12 from the stack 13.

In this respect, it should be realized that FIG. 2 illustrates a special case, in which the next adjacent sheet 13 has been pulled along with the advancing top sheet 12, and is being rejected by the fourth roller 36 until the second roller 33 is free to take up such next sheet 13. Even in that case, the sheet 12, being still present at the roller 33 when its trailing edge leaves the environment of the stack 19, and the adjacent sheet rejecting action of the reversely driven fourth roller 33, impose a delay between the moment at which the trailing edge of the sheet 12 leaves the confines of the stack 19 and the moment at which the already somewhat advanced adjacent sheet 13 can be taken up by the second roller 33 for advancement as the new top sheet in the direction of the arrow 78.

The mentioned delay is, of course, also present when the next adjacent sheet has not been dragged along from the stack 19 by the top sheet 12. In that case, the next adjacent sheet still has to be driven by the first roller 31 into the nip between second and fourth rollers 33 and 36 when the preceding top sheet has departed therefrom. However, while the roller 31 contacts the next adjacent sheet 13 as soon as the top sheet 12 has departed from such roller 31, there is a delay imposed by the free-wheeling action 105 before the roller 31 can drive the next adjacent sheet 13 as the new top sheet into engagement with the second roller 33.

In this respect, the arm 95, moving slower than the pulled roller 31, has to catch up with the advanced tooth 97, before the drive pulley 93 can rotate the roller 31 for an advancement of the next succeeding sheet 13. In terms of FIG. 3, the arm 95 first has to move along the arrow 105 back into phase or engagement with the advanced tooth 97 at 197, before any advancement of a preceding sheet by the first roller 31 can take place.

After the second roller 33 has thus taken up the adjacent sheet 13 after the mentioned delay, such roller 33 drives the taken up adjacent sheet 13 at the first location 32 away from the stack at the predetermined speed 78 as a new top sheet, while the fourth roller 36 rejects at the first location 32 any further adjacent sheet 14, etc., moving along with the new top sheet 13 from the stack. The third roller 35 thereupon engages the new top sheet 13 at the second location 34 while such new top sheet is still being driven at the first location 32. The second roller 33 continues to drive the new top sheet 13 at the first location 32 until such new top sheet has been driven past such first location. Until such time, the energy storage facility or torsion spring 72 at the third roller 35 is charged or tensioned by action of the motor 43 through pulleys 71 and 73 and transmission belt 74. Accordingly, upon departure of the new top sheet 13 from the first location 32, the third roller 35 and charged energy storage facility or tension spring 72 accelerate the engaged new top sheet 13 at the second location 34 away from the first location at a speed 79 higher than the predetermined speed 78.

This is repeated for each succeeding sheet 14, 15, 16, etc. individually, until the stack 19 has been emptied or unloaded into the apparatus 20.

In such unstacking operation, the delay between the advancement of a top sheet and the taking up of a succeeding sheet for advancement as a new top sheet may be provided by advancing initially each top sheet from the stack to the first location 32 at a speed lower than the predetermined speed 78, providing a free-wheeling action 105 in a drive (see FIG. 3) for the adjacent sheet as a result of the lower speed, and subjecting the adjacent sheet to the take up at the first location 32 after a termination of the free-wheeling action for advancement of the adjacent sheet at the predetermined speed 78 after the delay imposed by the free-wheeling action.

Still according to the illustrated preferred embodiment, the free-wheeling action 105 is provided by pulling each top sheet at the first location 35 from the stack 19 at the predetermined speed 78 being higher than the lower speed at which the first roller 31 advanced each top sheet in turn. The drive including the first roller 31 is engaged by the adjacent sheet 13 and the free-wheeling action 105 is taken up in such drive to advance the adjacent sheet 13 relative to the first location 32 when the free-wheeling action has been taken up.

According to a preferred embodiment of the subject invention, any adjacent sheet 13, etc., engaged by the first roller 31 after departure of the top sheet 12, etc., from such first roller can be advanced by that first roller 31 into driving engagement with the second roller 33 only after a reversal of the free-wheeling action 105.

The subject invention thus provides various safeguards which may be employed individually or collectively for assuring a rapid, safe and reliable unstacking operation without sheet jams and other distrubances, including erroneous readings or mixing up of accounts in subsequent processing equipment 20.

As indicated to some extent at the stack 19 in FIGS. 1 and 2, documents of various formats can readily be handled by the unstacking apparatus of the subject invention.

Due to the differential spaced between the second roller 33 and the somewhat slower driven first roller 31, and the free-wheeling action 105, a backlash is built up in the dog-drive 94 and has to be taken up before the first roller 31 can again advance a sheet into the nip of rollers 33 and 36.

In general, the relationship between the surface speed, $S_1$, of the second roller 33, the speed, $S_2$, of the first roller 31, the length, D, of any sheet 12 to 18, and the spacing, x, between the centers of rotation of first and second rollers 31 and 33 can be stated as follows:

$$\frac{S_2}{S_1} \leqq \frac{D-x}{D} \quad (1)$$

$$\frac{D}{x} \geqq \frac{S_1}{S_1 - S_2} \quad (2)$$

$$D \geqq \frac{x \cdot S_1}{S_1 - S_2} \quad (3)$$

Rearranging the terms given in equation (1) gives equation (2) or (3). This thus defines necessary relationships of parameters of the illustrated apparatus 10.

As may be seen from equation (2) or (3), various document lengths may be accommodated within certain drive ratios and roller spacings.

The subject extensive disclosure suggests and renders apparent to those skilled in the art various modifications and variations within the spirit and scope of the invention and equivalents thereof.

I claim:

1. In a method of transporting sheets from a stack, the improvement comprising in combination the steps of:

advancing from said stack each top sheet in turn to a first location;

rejecting at said first location any adjacent sheet moving along with said top sheet from said stack;

providing driving means for driving said advancing top sheet at said first location away from the stack;

engaging said top sheet at a second location while said top sheet is being driven at said first location;

continuing to drive said top sheet at said first location with said driving means until said top sheet has been driven past said first location; and accelerating said engaged top sheet at said second location away from said first location only after said top sheet has been driven past said first location.

2. A method as claimed in claim 1, including the steps of:

taking up said adjacent sheet at said first location for advancement only after a delay from a departure of said top sheet from said stack;

driving said taken up adjacent sheet at said first location with said driving means away from said stack as a new top sheet while rejecting at said first location any further adjacent sheet moving along with said new top sheet from said stack;

engaging said new top sheet at said second location while said new top sheet is being driven at said first location;

continuing to drive said new top sheet at said first location with said driving means until said new top sheet has been driven past said first location; and accelerating said engaged new top sheet at said second location away from said first location only after said top sheet has been driven past said first location.

3. A method as claimed in claim 1 or 2, wherein:

each top sheet is initially advanced from said stack to said first location at a speed lower than any speed at which said driving means drive said top sheet away from the stack.

4. A method as claimed in claim 2, wherein:

said delay is provided by advancing initially each top sheet from said stack to said first location at a speed lower than any speed at which said driving means drive said top sheet away from the stack, providing a free-wheeling action in a drive for said adjacent sheet as a result of said lower speed, and subjecting said adjacent sheet to said take up at said first location after a termination of said free-wheeling action for advancement of said adjacent sheet after said delay.

5. A method as claimed in claim 4, wherein:

said free-wheeling action is provided by pulling each top sheet at said first location from said stack at a speed higher than said lower speed; and said drive is engaged by said adjacent sheet and said free-wheeling action is taken up in said drive to advance said adjacent sheet relative to said first location when said free-wheeling action has been taken up.

6. In apparatus for transporting sheets from a stack, the improvement comprising in combination:

means for advancing from said stack each top sheet in turn to a first location;

means at said first location for rejecting any adjacent sheet moving along with said top sheet from said stack;

means for driving said advancing top sheet at said first location away from the stack; and means spaced from said driving means for engaging said top sheet at a second location while said top sheet is being driven at said first location;

means coupled to said means for driving said advancing top sheet at said first location for continuing to drive said top sheet at said first location with said means for driving said sheet at said first location until said top sheet has been driven past said first location;

said top sheet engaging means including means for accelerating said engaged top sheet at said second location away from said first location only after said top sheet has been driven past said first location.

7. Apparatus as claimed in claim 6, including:

means for placing said adjacent sheet into driving engagement with said driving means at said first location for advancement only after a delay from a departure of said top sheet from said stack.

8. Apparatus as claimed in claim 6 or 7, wherein:

said placing means include means for initially advancing each top sheet from said stack to said first location at a speed lower than any speed at which said driving means drive said top sheet away from the stack.

9. Apparatus as claimed in claim 7, wherein:

said placing means include a drive for initially advancing each top sheet from said stack to said first location at a speed lower than any speed with said driving means drive said top sheet away from the stack, means for providing a free-wheeling action in said drive for said adjacent sheet as a result of said lower speed and for taking up said free-wheeling action for advancement of said adjacent sheet at said predetermined speed after a delay imposed by said taking up said free-wheeling action.

10. Apparatus as claimed in claim 9, wherein:

said free-wheeling action providing means include means for pulling each top sheet at said first location from said stack at a speed higher than said lower speed.

11. In apparatus for transporting sheets from a stack, the improvement comprising in combination:

means include a first roller at said stack for advancing from said stack each top sheet in turn to a first location;

means at said first location for rejecting any adjacent sheet moving along with said top sheet from said stack;

means including a second roller at said first location for driving said advancing top sheet away from the stack to a second location;

means including a third roller at said second location for engaging said top sheet while said top sheet is being driven at, and after said top sheet has been driven past, said first location, energy storage means connected to said third roller for accelerating said engaged top sheet with said third roller away from said first location after said top sheet has been driven past said first location, and means connected to said energy storage means for charging said energy storage means while said top sheet is being driven at said first location.

12. Apparatus as claimed in claim 11, including:

means for placing said adjacent sheet into driving engagement with said second roller at said first location for advancement only after a delay from a departure of said top sheet from said stack.

13. Apparatus as claimed in claim 11 or 12, wherein:

said placing means include means for initially advancing each top sheet from said stack to said first location at a speed lower than any speed at which said means including said second roller drive said sheet away from the stack.

14. In apparatus for transporting sheets from a stack, the improvement comprising in combination the steps of:

means including a first roller at said stack for engaging each top sheet of said stack in turn, means for driving said first roller for advancement from said stack of each top sheet in turn at a first speed to a first location, and means for allowing between said first roller driving means and said first roller a free-wheeling action exceeding in speed said driving of the first roller;

means at said first location for rejecting any adjacent sheet moving along with said top sheet from said stack;

means including a second roller at said first location for engaging said advancing top sheet during said engagement by said first roller and for driving said advancing top sheet away from said first roller at a speed higher than said first speed to provide said free-wheeling action between said first roller driving means and said first roller whereby any adjacent sheet engaged by said first roller after departure of said top sheet from said first roller can be advanced by said first roller into driving engagement with said second roller only after a reversal of said free-wheeling action;

energy storage means at a second location spaced from said first location for accelerating said top sheet away from said first location only after said top sheet has been driven past said first location; and means coupled to said energy storage means for charging said energy storage means while said top sheet is being driven by said second roller away from said first roller.

15. Apparatus as claimed in claim 14, wherein:

said energy storage means are spaced from said second roller for engaging said top sheet at said second location while said top sheet is being driven at said first location and for accelerating said engaged top sheet at said second location away from said first location only after said top sheet has been driven past said first location.

16. In apparatus for transporting sheets from a stack, the improvement comprising in combination the steps of:

means including a first roller at said stack for engaging each top sheet of said stack in turn, means for driving said first roller for advancement from said stack of each top sheet in turn at a first speed to a first location, and means for allowing between said first roller driving means and said first roller a free-wheeling action exceeding in speed said driving of the first roller;

means at said first location for rejecting any adjacent sheet moving along with said top sheet from said stack;

means including a second roller at said first location for engaging said advancing top sheet during said engagement by said first roller and for driving said advancing top sheet away from said first roller at a speed higher than said first speed to provide said free-wheeling action between said first roller driving means and said first roller whereby any adjacent sheet engaged by said first roller after departure of said top sheet from said first roller can be advanced by said first roller into driving engagement with said second roller only after a reversal of said free-wheeling action; and means including a third roller at a second location spaced from said second roller for engaging said top sheet while said top sheet is being driven at, and after said top sheet has been driven past, said first location, energy storage means connected to said third roller for accelerating said engaged top sheet with said third roller away from said first location only after said top sheet has been driven past said first location, and means connected to said energy storage means for charging said energy storage means while said top sheet is being driven at said first location.

17. Apparatus as claimed in claim 11 or 16, wherein:

said energy storage means include a spring;

and said charging means include means for tensioning said spring.

18. Apparatus as claimed in claim 11 or 16, wherein:

said charging means include means for rotating said third roller; and said energy storage means include a torsion spring connected between said third roller and said means for rotating said third roller.

19. A method as claimed in claimed in claim 1, wherein said acceleration includes the steps of:

providing energy storage means;

charging said energy storage means while the top sheet is being driven at said first location; and accelerating said engaged top sheet at said second location with said charged energy storage means away from said first location.

20. Apparatus as claimed in claim 6, wherein said accelerating means include:

energy storage means;

means for charging said energy storage means while said top sheet is being driven at said first location; and means coupled to said energy storage means for accelerating said engaged top sheet at said second location with said charged energy storage means away from said first location.

* * * * *